United States Patent [19]

Erilli et al.

[11] Patent Number: 4,671,895

[45] Date of Patent: Jun. 9, 1987

[54] LIQUID DETERGENT COMPOSITIONS

[75] Inventors: Rita Erilli, Rocourt; Myriam Mondin, Seraing S/Meuse, both of Belgium

[73] Assignee: Colgate-Palmolive Company, New York, N.Y.

[21] Appl. No.: 798,339

[22] Filed: Nov. 15, 1985

[51] Int. Cl.[4] ..... C11D 1/83

[52] U.S. Cl. ..... 252/552; 252/531; 252/533; 252/535; 252/550; 252/554; 252/173; 252/174.21; 252/DIG. 14

[58] Field of Search ..... 252/535, 531, 533, 550, 252/552, 554, 173, 174.21, DIG. 14

[56] References Cited

U.S. PATENT DOCUMENTS

| | | | |
|---|---|---|---|
| 3,231,504 | 1/1966 | Marion et al. | 252/137 |
| 3,757,206 | 8/1973 | Verdier | 252/545 |
| 3,812,042 | 5/1974 | Verdier | 252/90 |
| 4,040,989 | 8/1977 | Renaud et al. | 252/548 |
| 4,056,113 | 11/1977 | Johnson et al. | 252/DIG. 14 |

FOREIGN PATENT DOCUMENTS

| | | |
|---|---|---|
| 1339069 | 11/1973 | United Kingdom . |
| 1458798 | 12/1976 | United Kingdom . |
| 1458783 | 12/1976 | United Kingdom . |
| 1567421 | 5/1980 | United Kingdom . |

OTHER PUBLICATIONS

McAteer & Kinnard, "Sodium Alkane Sulfonates—Dependence of Properties on Molecular Weight," Chem. Phys. Appl-Surf Act. Subst. Proc. Int. Congr. 4th 1964 (pub. 1967), 1 127.

Dr. Stache, "Hydrotrope Substanzen fur die Herstellung flussiger Waschmittel," Fette-Seifen-Anstrichmittel, Nr. 5 (1969).

G. Tauber, "Paraffinsulfonat und seine Verwendung als Waschrohstoff," vol. III, Section C du Programme du Congres, Applications Pratiques des Agents de Surface, pp. 211-217.

*Primary Examiner*—Paul Lieberman
*Assistant Examiner*—Hoa Van Le
*Attorney, Agent, or Firm*—Herbert S. Sylvester; Murray M. Grill; Norman Blumenkopf

[57] ABSTRACT

Liquid detergent compositions based on paraffin sulfonate, ethoxylated higher alcohol sulfate, nonionic surfactant and a small amount of an alcohol sulfate wherein the alcohol (alkyl group) of the alcohol sulfate has at least two fewer carbon atoms than that of the higher alcohol sulfate are clear and stable. These liquid detergent compositions can be made highly concentrated in terms of detergent active ingredients, for example, up to 50% or more of active ingredients. A typical example includes about 30 weight % paraffin sulfonate, 3 weight % $C_{12}$-$C_{15}$ alkyl ether sulfate EO 3:1, Na salt, 6 weight % $C_9$-$C_{11}$ fatty alcohol ethoxylate EO 8:1, 1 weight % $C_8$-$C_{10}$ alkyl sulfate, Na salt, the balance being water with optional dye and fragrance.

11 Claims, No Drawings

LIQUID DETERGENT COMPOSITIONS

This invention relates to clear and stable liquid detergent compositions, such as might be used for cleaning dishes. More particularly, this invention relates to clear, stable liquid detergent compositions containing high levels of detergent/surfactant active compounds but which do not include any of the conventional non-detergent solubilizers or hydrotropes to achieve the clarity or stability.

Liquid detergent compositions containing sodium dodecyl benzene sulfonate and ammonium alkyl ether sulfate are known from, for example, U.S. Pat. No. 3,231,504. However, in order to formulate compositions containing these detergent active compounds at acceptably high levels, it is necessary to include relatively high amounts of solubilizing agents or hydrotropes. The lower aliphatic alcohols (e.g. ethyl alcohol), urea, alkyl benzene sulfonate (e.g. sodium xylene sulfonate) are representative of the solubilizing agents and hydrotropes.

Various improvements in these liquid detergent compositions have been provided by replacing all or part of the higher alkyl benzene sulfonate anionic detergent with a paraffin sulfonate anionic detergent. For instance, reference can be made to British Patent Specification No. B 1,339,069 (amended specification) published Nov. 28, 1973 and its counterpart U.S. Pat. No. 3,755,206, as well as U.S. Pat. No. 3,812,042 and British Patent Specification No. 1,567,421. All of these patented formulations still require the addition of a hydrotrope or solubilizing agent, referred to as a "viscosity and clarity control system" in order to achieve the desired degree of clarity and concentration. Therefore, to the extent that the viscosity and clarity control system (typically a mixture of ethyl alcohol and/or propyl alcohol with urea) occupies space in the composition, the relative concentration of detergent active compounds is necessarily reduced. That is, the viscosity and clarity control system does not contribute to the overall cleaning performance of the liquid detergent composition.

Other paraffin sulfonate based liquid detergent compositions are described in U.S. Pat. No. 4,040,989, and British Patent Specifications Nos. 1,458,798 and 1,458,783—but these all require relatively specialized and expensive nonionic detergent compounds such as mixed ethylene-propylene oxide condensates, tertiary amine oxides, alkanoic acid alkanolamide, etc.

It would be highly desirable, therefore, and it is an object of this invention to provide still further improvements upon these prior paraffin sulfonate based clear stable liquid detergent compositions.

A specific object of this invention is to provide clear stable liquid detergent compositions based on paraffin sulfonate with ethoxylated alcohol sulfate and nonionic detergent which compositions can be highly concentrated, for example, up to about 50 weight percent or more of active ingredients, yet which does not include any non-detergent active solubilizer or hydrotrope material.

These and other objects of the invention which will become more readily apparent from the following detailed description and preferred embodiments of the invention have been accomplished by the discovery that the viscosity and clarity control system of hydrotropic and solubilizing agents can be replaced by a relatively low, e.g. about 8 to 10, carbon chain length alcohol sulfate anionic detergent compound in combination with a conventional ethoxylated fatty alcohol nonionic detergent compound thereby lowering the overall cost of the compositions and permitting higher total levels of active ingredients without sacrificing clarity or stability.

Accordingly, the present invention provides clear liquid detergent compositions in the form of a clear aqueous solution of from about 15 to about 40 weight % paraffin sulfonate, from about 1 to about 10 weight % of an alkyl ether sulfate having from about 12 to 15 carbon atoms in the alkyl chain, from about 2 to about 20 weight % of ethoxylated fatty alcohol nonionic detergent and from about 0.8 to about 5 weight % of a $C_6$ to $C_{11}$ alcohol sulfate salt, the balance being water, dyes, perfumes, preservatives and other conventional adjuvants.

The compositions of this invention provide rich stable high foaming cleaners, especially suitable for the hand washing of soiled dishes, glassware and cutlery.

The water soluble paraffin sulfonates, also known as alkane sulfonates, employed in the present invention are usually mixed secondary alkyl sulfonates having from 10 to 20 carbon atoms per molecule with at least about 80% thereof being either 12 to 18 carbon atoms per molecule or 10 to 17 carbon atoms per molecule. A preferred range of carbon atom contents is from 14 to 17 carbon atoms with an average carbon atom content of about 15. The preferred molecular weight normally ranges from 300 to 350.

The described paraffin sulfonates are preferably prepared by subjecting a cut of paraffin, corresponding to the chain length specified above, to the action of sulfur dioxide and oxygen in accordance with the well known sulfoxidation process. The product of this reaction is a secondary sulfonic acid, which is then neutralized with a suitable base to produce the water soluble secondary alkyl sulfonate. Similar useful secondary alkyl sulfonates may be obtained by other methods, e.g. by the sulfochlorination technique, in which chlorine and sulfur dioxide are reacted with paraffin in the presence of metal, ammonium or lower alkanol amine, although alkaline earth actinic light, with the resulting sulfuryl chlorides being hydrolyzed and neutralized to form the secondary alkyl sulfonates.

The cation of the paraffin sulfonate and of the anionic sulfates to be described below is preferably an alkali metals, e.g. magnesium, and lower amines are also useful in forming the water soluble detergent salts. The better of the alkali metals are sodium and potassium, with sodium being preferred. The lower alkanolamines may be mono-, di- or trialkanolamines containing 1 to 3 carbon atoms in the alkanol group, and most preferably, ethanolamines, e.g. triethanolamine and diethanolamine. The corresponding amines may be used instead. The most preferred of the paraffin sulfonates is the sodium paraffin sulfonate wherein the paraffin is essentially (80% or more and preferably 95% or more) of a molecular weight of about 330.

The paraffin sulfonate is present in the composition in amounts of from about 15 to about 40 percent by weight, preferably from about 25 to 35 percent by weight. At concentrations above 40%, it is difficult to solubilize the paraffin sulfonate even at the higher levels of nonionic and alkyl sulfate such that only cloudy compositions can be obtained. At amounts below about 15% cleaning performance is not sufficient.

The higher alkyl ether sulfates used in the present invention are represented by the formula:

$$RO(C_2H_4O)_nSO_3M$$

in which R is a primary or secondary alkyl group that may be straight or branched having from 10 to 18 carbon atoms, preferably 12 to 15, especially 12 to 14, and most preferably 12 to 13 carbon atoms, M is a suitable cation, as defined above for the paraffin sulfonate, and n is a number from 1 to 10, preferably 2 to 6, especially 2 or 3. These detergents are produced by sulfating the corresponding ether alcohol and then neutralizing the resulting sulfuric acid ester thereof. The sodium and ammonium salts of the ether sulfates are especially preferred.

The higher alkyl ether sulfate is present in the composition in amounts of from about 1 to about 10% by weight, preferably about 2 to about 8% by weight. At amounts of the ether sulfate above and below these ranges cleaning performance, foaming, or stability are not totally satisfactory.

The nonionic detergent which is another essential ingredient in the clear stable liquid detergent compositions of this invention functions with the alkyl sulfate to be described below to help solubilize the paraffin sulfonate and higher alkyl ether sulfate components and to provide suitable foaming characteristics, i.e. as foam builders. The nonionic detergent also helps to stabilize the composition at low temperatures. Suitable nonionics for use in this invention include the liquid ethoxylated fatty alcohols which may be represented by the following structural formula $$R^1O(C_2H_4O)_mH$$

in which $R^1$ is an alkyl, which may be straight or branched, and which contains from about 8 to 12 carbon atoms in the molecule, and m is a number of from about 5 to 10, on average, generally from about 5 to 8, on average.

Usually $R^1$ will be a mixture of straight alkyl groups with, for example, chain lengths of 9–11 carbon atoms, 8–10 carbon atoms, 10–12 carbon atoms, etc. Mixed alkyl chain lengths of from 9 to 11 carbon atoms are particularly useful. Similarly, the alkyl groups of the ether sulfates will typically be mixtures of varying carbon chain lengths wherein usually at least 80%, preferably at least about 95% will be within the specified ranges. The nonionic detergents can be treated, as by distillation, to remove the free starting alcohol and low ethoxylates and such "topped" nonionics are commercially available.

The nonionic detergent is present in the composition in amounts of from about 2 to about 20% by weight, preferably from about 5 to about 15% by weight. At amounts of the nonionic below about 2 wt % in the compositions scarcely any effect in foam boosting or solubilizing the remaining ingredients is observed. Amounts of the nonionic larger than about 20 wt %, on the other hand do not provide any significant improvement in cleaning performance and so the use of such high amounts of nonionic should be avoided. On the other hand, within the range of 2 to 20 wt %, especially 5 to 15 wt %, the presence of the nonionics together with the alkyl sulfate, especially at very high total levels of detergent active ingredients, promotes the solubility of the detergent compounds and enables clear, stable solutions to be formed.

The alkyl sulfate anionic detergent compounds which are useful in the present invention have from 6 to 11, especially from 8 to 10 carbon atoms in the alkyl group and can be represented by the following general formula $$R^2SO_4M$$

in which $R^2$ is straight or branched chain alkyl of from 6 to 11, especially from 8 to 10 carbon atom chain length and M is as defined above, especially sodium. Straight chain alkyl groups are preferred.

With alkyl chain lengths of the alkyl sulfate of 12 or more carbon atoms, for example 12 to 14 carbon atoms, the detergent active compounds, particularly at high total levels of detergent active ingredients, for example, at least 40 percent by weight of the total compositions, especially at least 45 wt %, are not totally soluble and the resulting compositions are cloudy at room temperature.

In the following compositions "EO" represents ethylene oxide, thus, for example, $C_{12}$–$C_{15}$ alcohol EO (3:1) Na sulfate refers to the condensation product of 1 mole of fatty alcohol sulfate with 3 moles of ethylene oxide and $C_9$–$C_{11}$ fatty alcohol EO (8:1) refers to the condensation product of the fatty alcohol with 8 moles ethylene oxide.

For example, the following compositions "A" and "B" at a 40 weight percent total active ingredient concentration are prepared by mixing all of the ingredients at room temperature.

| Ingredient | A Weight % | B Weight % |
|---|---|---|
| $C_{14}$–$C_{17}$ alkane sulfonate, Na | 26.0 | 26.0 |
| $C_{12}$–$C_{15}$ alcohol EO (3:1) Na sulfate | 4.2 | 4.2 |
| $C_9$–$C_{11}$ fatty alcohol EO (8:1) | 8.4 | 8.4 |
| $C_8$–$C_{10}$ alkyl sulfate | 1.2 | — |
| $C_{12}$–$C_{14}$ alkyl sulfate | — | 1.2 |
| water | balance | balance |

Composition "B" is cloudy, whereas Composition "A" is clear. Such cloudy compositions are generally unacceptable to the consumer, especially where the compositions are provided in clear glass or plastic bottles.

The amount of the alkyl sulfate is also important. At concentration of alkyl sulfate of less than about 0.8 percent by weight, the solubilizing effect is insufficient. At concentrations above about 5 weight % for any given total concentration of detergent active ingredients, the overall cleaning performance is diminished. Therefore, the amount of the alkyl sulfate anionic detergent component should be in the range of from about 0.8 to about 5 weight %, preferably from about 1 to about 3 weight %.

It is one of the features of the present invention that the clear aqueous liquid dishwashing detergent compositions can be prepared with high total levels of the detergent active compounds as described above, especially at levels of at least about 40%, preferably at least about 45%, and especially preferably at least about 50%, by weight of the total composition. Clear stable compositions containing as much as about 70 weight %, for example, up to about 65%, especially up to about 60%, such as from about 50 to about 60% by weight of the total composition can be prepared.

The detergent compositions according to this invention should have clear point temperatures of at most about 15° C. (59° F.), preferably no more than about 13° C. (55.5° F.). The clear point temperature can be easily determined by the following procedure. A sample composition is prepared and placed in a glass test tube which is then placed overnight in a freezer (about −4° C.). The test tube is then removed from the freezer and the temperature is increased at a rate of about 1° C. per minute. The temperature at which the composition changes from cloudy to clear is the clear point temperature.

The viscosities of the detergent compositions may be further varied by the addition of thickening agents such as gums and cellulose derivatives. The product viscosity and flow properties should be such as to make it pourable from a bottle and not so thin as to tend to splash or pour too readily, since usually only small quantities of the liquid detergent are to be utilized in use. Viscosities from 20 to 500 centipoises (Brookfield Viscometer) are found useful with those from 50 to 300 cps. being preferred and a viscosity of about 200 centipoises being considered best by most consumers, although at somewhat lower viscosities, e.g. 100 cps, consumer acceptance is almost the same.

The liquid detergents of the present invention may also contain any of the additives heretofore used in other liquid detergent compositions such as sequestrants, e.g. salts of ethylenediamine tetraacetic acid, such as the sodium and potassium salts, and salts of hydroxyl ether ethylene diamine triacetate. It is desirable in some cases to tint or color the liquid detergent composition and any suitable dyes may be used for this purpose. Perfume may also be added to these compositions to give them a pleasant odor. Preservatives, germicides, bacteriocides and the like also may be included in the compositions.

Water is used as the liquid vehicle for the liquid detergent compositions of the present invention. It will vary in proportion from about 20 to 60 percent, depending upon the content of the other ingredients of the composition.

The compositions generally have a nuetral pH (7) but pH's of from 5 to 9, preferably from 6 to 8, are satisfactory.

In order to demonstrate the various advantages of the liquid detergent compositions of this invention, the following formulation are prepared:

Stable and clear formulations with useful viscosities can be prepared over a wide range of concentrations of active ingredients to and including total active ingredients in excess of 50 weight %.

At the same total active ingredient level (52.5 wt %) increasing the amount of the nonionic (with a corresponding decrease in paraffin sulfonate) results in clarification of an otherwise cloudy composition—Compare Run No. 5 (comparison) with Run No. 6 (Invention).

At low total active ingredient levels of about 25% and 30%, the mixture of paraffin sulfonate and alkyl ether sulfate is at the borderline or slightly above acceptable clear points (see Comparative Run Nos. 7 and 9, respectively); at the same total active ingredient levels of 25% and 30% replacing a portion of the paraffin sulfonate and alkyl ether sulfate with the nonionic detergent and lower alkyl sulfate results in perfectly acceptable clear compositions, albeit at relatively low total concentration of active ingredients (see Run Nos. 8 and 10, respectively).

As the amount of the lower alkyl sulfate anionic detergent approaches 5 wt % (Run No. 11), the clear point is still acceptable, but outside the preferred value of less than about 13° C.

The compositions of Run Nos. 3, 4 and 11 are tested to measure cleaning performance of several typical formulations according to the invention. For comparison, the cleaning performance of a composition (Run No. 12) in which each of the paraffin sulfonate, alkyl ether sulfate, nonionic and alkyl sulfate are used at the 10 wt % level (total active ingredients 40 wt %, clear point 7° C., viscosity 235 cps) is also measured. The performance test is a dishwashing test which was carried out at two different levels of water hardness, viz. at 50 and 300 parts per million (ppm) of hardness, and at a concentration of detergent of 1.25 grams per liter, for each level of water hardness.

The dishwashing tests are carried out by uniformly soiling standard plates with a soil which consists of a commercial hydrogenated fatty (cottonseed) oil by spreading a small amount, equally, on each plate.

The plates are washed in dishpans which contain 6 liters of wash water at 43° C. Each of the compositions to be tested (at the two different water hardnesses) is prepared and placed, separately, in different dishpans. The plates are then washed in the dishpans to an end point of a permanent break in the foam covering the dishpan; the number of plates which can be washed to that end point is noted and recorded. A difference of 2 plates in the results obtained is generally considered necessary in order to be significant at a 95% confidence

| | WEIGHT % RUN NO. | | | | | | | | | | |
|---|---|---|---|---|---|---|---|---|---|---|---|
| Ingredient | 1 | 2 | 3 | 4 | 5 | 6 | 7 | 8 | 9 | 10 | 11 |
| Paraffin sulfonate, Na salt ($C_{14}$–$C_{17}$) | 27 | 32.5 | 30 | 26 | 34.15 | 31.5 | 20 | 16.25 | 24 | 19.5 | 26 |
| Alkyl ether sulfate, Na salt ($C_{12}$–$C_{15}$ alcohol EO 3:1) | 3.8 | 5.25 | 3 | 4.2 | 8.5 | 5.5 | 5 | 2.6 | 6 | 3.25 | 4.6 |
| Nonionic detergent ($C_9$–$C_{11}$ fatty alcohol EO 8:1) | 5.4 | 10.5 | 6 | 8.4 | 11.0 | 13.65 | — | 5.25 | — | 6.25 | 4.7 |
| Alkyl sulfate, Na salt ($C_8$–$C_{10}$ alkyl) | 3.8 | 1.75 | 1 | 1.4 | 1.85 | 1.85 | — | 0.9 | — | 1.0 | 4.7 |
| Perfume/dye/water | BALANCE | | | | | | | | | | |
| Total Active Ingredients | 40 | 50 | 40 | 40 | 52.5 | 52.5 | 25 | 25 | 30 | 30 | 40 |
| Clear Point | <13° C. | 9° C. | 7° C. | 4° C. | >25° C. | 12° C. | 21° C. | 4° C. | >13° C. | 6° C. | 14° C. |
| Viscosity (cps)* | | 280 | 200 | 200 | | 300 | 150 | 150 | 375 | 160 | 240 |

*Measured with Brookfield viscometer-LVT, spindle No. 2 at 30 r.p.m. and 20° C.

From the above results, the following conclusions can be drawn.

level. The results reported below are based on the average of 3 replicate runs.

| Run No. | Composition | Total AI | Cleaning Performance 50 ppm | Cleaning Performance 300 ppm |
|---|---|---|---|---|
| 3 | 30% PS/3% ES/6% NI/ 1% AS | 50 | 53.5 | 57 |
| 4 | 26% PS/4.2% ES/8.4% NI/ 1.4% AS | 40 | 44.5 | 52 |
| 11 | 26% PS/4.6% ES/4.7% NI/ 4.7% AS | 40 | 42 | 52 |
| 12 | 10% PS/10% ES/10% NI/ 10% AS | 40 | 16 | 31 |

PS = Paraffin sulfonate
ES = alkyl ether sulfate
NI = nonionic
AS = alkyl sulfate
AI = active ingredients, wt %

From these results, it can be seen that the more concentrated composition (Run No. 3) provides the most outstanding cleaning performance, while the cleaning performance of Run Nos. 4 and 11 is very good. The composition of Run No. 12 which is outside the scope of the invention is inferior in cleaning performance at both hardness levels even though its clarity and viscosity are otherwise acceptable.

If, in the compositions of Run Nos. 1, 2, 3, 4, 6 or 11, a $C_9$–$C_{11}$ fatty alcohol EO 5:1 is used in place of the $C_9$–$C_{11}$ fatty alcohol EO 8:1 similar results are obtained. Similarly, if in any of these compositions a $C_{12}$–$C_{15}$ alkyl ether sulfate EO 2:1, Na salt, or ammonium salt is used in place of the $C_{12}$–$C_{15}$ alkyl ether sulfate EO 3:1, Na salt, similar results are obtained.

A clear, stable but more highly viscous composition is prepared containing 60 wt % of the active ingredients used in Run Nos. 1, 2, 3, 4, 6 and 11:

| | |
|---|---|
| Paraffin Sulfonate | 36% |
| Alkyl ether sulfate | 6.3% |
| Nonionic | 15.6% |
| Alkyl sulfate | 2.1% |
| Total Actives | 60% |
| Clear Point | <13° C. |
| Viscosity | 500 cps. |

What we claim is:

1. A clear aqueous laundry detergent composition which is free of non-detergent solubilizers and hydrotropes and comprises
(A) paraffin sulfonate anionic detergent in an amount of from about 15 to about 40% by weight;
(B) alkyl ether sulfate anionic detergent wherein the alkyl group has from 12 to 15 carbon atoms in an amount of from about 1 to about 10% by weight;
(C) nonionic detergent in an amount of from about 2 to about 20% by weight;
(D) alkyl sulfate anionic detergent wherein the alkyl group has from 6 to 11 carbon atoms in an amount of from about 0.8 to about 5% by weight, the sum of (A)+(B)+(C)+(D) being at least 40% by weight of the total composition; and
(E) water.

2. The composition of claim 1 wherein the sum of (A)+(B)+(C)+(D) is from about 40% to about 60% of the total weight of the composition.

3. The composition of claim 2 wherein the sum is at least about 50% by weight.

4. The composition of claim 1 wherein the paraffin sulfonate has an average of from 14 to 17 carbon atoms.

5. The composition of claim 1 wherein the alkyl ether sulfate is a compound of the formula $$RO(C_2H_4O)_nSO_3M$$

in which R is a primary or secondary branched or straight chain alkyl group having from 12 to 14 carbon atoms, M is an alkali metal, ammonium or lower alkanolamine, and n is a number of from 1 to 10.

6. The composition of claim 5 wherein R is an alkyl of from 12 to 13 carbon atoms, M is a sodium or ammonium cation, and n is a number of from 2 to 6.

7. The composition of claim 1 wherein the nonionic detergent is an ethoxylated fatty alcohol of the formula $$R^1O(C_2H_4O)_mH$$

in which $R^1$ is a straight or branched alkyl of from 8 to 12 carbon atoms and m is a number of from 5 to 10.

8. The composition of claim 7 wherein R is alkyl having from 9 to 11 carbon atoms and m is a number of from 5 to 8.

9. The composition of claim 1 wherein the alkyl sulfate is a compound of the formula $$R^2SO_4M$$

in which $R^2$ is a straight or branched chain alkyl of from 6 to 11 carbon atoms and M is an alkali metal, ammonium or lower alkanolamine.

10. The composition of claim 1 which comprises
(A) from about 25 to 35% by weight,
(B) from about 2 to 8% by weight,
(C) from about 5 to 15% by weight,
(D) from about 1 to 3% by weight, and
(E) water.

11. A clear aqueous laundry detergent composition which is free of non-detergent solubilizers and hydrotropes and comprises
(A) $C_{14}$–$C_{17}$ paraffin sulfonate in an amount of from about 25 to 35 weight percent,
(B) $C_{12}$–$C_{15}$ alkyl ether sulfate EO 3:1 in an amount of from about 2 to 8 weight percent,
(C) $C_9$–$C_{11}$ fatty alcohol condensed with 8 moles ethylene oxide in an amount of from about 5 to 15 weight percent,
(D) $C_8$–$C_{10}$ alkyl sulfate in an amount of from about 1 to 3 weight percent, and
(E) water.

* * * * *